United States Patent [19]

Lehner

[11] Patent Number: 4,591,159

[45] Date of Patent: May 27, 1986

[54] WHIRLIGIG

[76] Inventor: Attila Lehner, 80 Pine Ave., West - Apt. 1403, Montreal, Quebec, Canada, H2W 1R1

[21] Appl. No.: 789,314

[22] Filed: Oct. 18, 1985

[51] Int. Cl.[4] ..... A63F 5/04

[52] U.S. Cl. ..... 273/138 R; 273/142 G

[58] Field of Search ..... 273/142 G, 142 R, 142 C, 273/142 D, 142 E, 142 F, 138 R, 138 A

[56] References Cited

U.S. PATENT DOCUMENTS

| | | | |
|---|---|---|---|
| 1,468,984 | 9/1923 | Weaver | 273/142 G |
| 1,491,961 | 4/1924 | Miller | 273/142 E |
| 1,925,924 | 9/1933 | Hummel | 273/142 E X |
| 2,001,500 | 5/1935 | Rothen | 273/138 R |
| 2,104,740 | 1/1938 | Evans | 273/142 |
| 2,525,716 | 10/1950 | Okamoto | 273/138 R |
| 2,607,592 | 8/1952 | Finnerty | 273/138 R X |
| 3,645,530 | 2/1972 | Hernandez et al. | 273/138 R |

FOREIGN PATENT DOCUMENTS

| | | | |
|---|---|---|---|
| 39383 | 4/1892 | Canada . | |
| 2380797 | 10/1978 | France | 273/142 E |
| 431790 | 3/1948 | Italy | 273/142 E |
| 185000 | 8/1922 | United Kingdom | 273/142 E |
| 978701 | 12/1964 | United Kingdom | 273/142 G |

*Primary Examiner*—Paul E. Shapiro

[57] ABSTRACT

A game of chance comprising a stationary base and a rotatable casing cover overlying the base is disclosed. The casing cover is generally spherical. A saucer disk is disposed inside the casing cover to rotate bodily therewith. The top of the casing cover is formed with a knob and at least one slit adjacent thereto. The bottom of the casing cover has an opening directly over the base. The latter has a trough and at least two partitions defining segments in the trough. To play the game, players drop tokens through the slit onto the saucer disk. Then the casing cover is spun, so that the tokens are held against the inner wall of the casing by centrifugal force and drop by gravity randomly into the trough segments as the casing slows down.

9 Claims, 2 Drawing Figures

WHIRLIGIG

FIELD OF THE INVENTION

The present invention relates to games of chance generally, more specifically to a spinning device which can be enjoyed by children as well as adults who have a penchant for gambling, and commonly known as a whirlizig.

BACKGROUND OF THE INVENTION

Games of chance have always been popular as pastimes for adults, perhaps because they satisfy human nature in that it is pleasant to win. In a real game of chance, the random possibility of gain is at a maximum and, therefore, every player has an equal mathematical chance. Children may also play such games but with a more simple spirit of sharing a playful device.

The instant invention seeks to provide a game of chance achieved by a novel spinning element and stationary receptacle.

Related games are known in the prior art, for example "roulette". Another example is found in the Canadian Patent No. 39,383, issued April 21, 1892 to Prendergast, which discloses a game wherein the object is to drop small balls onto a spinning disk C. However, the cover has to be removed twice: once to spin the disk and another time to calculate the score. Such an inconvenience could be improved upon.

Another patent is the one issued to Evans on Jan. 11, 1938 in the U.S. and bearing U.S. Pat. No. 2,104,740. Two disks are disposed in a bowl in vertical spaced-apart relationship. The upper disk is vertically movable. The second lower disk is rotated when the upper disk is low. That invention involves a relatively complex assembly and is designed for a relatively restricted market.

OBJECTS OF THE INVENTION

It is a first object of the instant invention to provide a game of chance which innovatively combines gravity and centrifugal force in a spinning element enclosed within a rotatable casing cover mounted over a stationary base.

It is another object of the present invention to provide a game of the above type, which is enjoyable by people of all ages and which is visually appealing.

It is yet another object of the present invention to provide a game of the above type, which is simple in design.

SUMMARY OF THE INVENTION

The above and other objects and advantages of the invention are carried out according to a preferred embodiment comprising a stationary base, which is of symmetrical construction, preferably circular, and has a central raised hub. The base is provided with leveling means enabling players to adjust it to be perfectly horizontal on a symmetrical surface.

The base is formed with a trough spaced away from and surrounding the hub. This trough serves to receive tokens, metal coins or the like markers, as explained below.

The trough is provided with at least two partitions, preferably removable, so that at least two segments, one or more for each player, are defined in the trough.

The hub of the base fixedly retains the lower end of a vertically-upwardly-projecting spindle defining a central vertical axis.

Rotatably mounted by a mounting means around the spindle and above the base is a casing cover having a lowermost opening which is less than the diameter of the base. The casing cover is formed, preferably integrally so, with a knob at its uppermost portion. Gripping means are preferably provided to spin the knob and hence the entire casing. The top of the knob is preferably provided with a level-indication means for the leveling means disclosed above.

Also rotatably mounted on the mounting means and in the middle area of the casing cover is a horizontal saucer disk of a diameter less than the inner horizontal diameter of the middle area. The saucer rotates bodily with the casing cover.

The upper portion of the casing cover is further made with at least one slit. The latter is for the tokens or coins to be dropped therethrough.

To play with the whirligig of the invention, a token is dropped through the slot and falls on the saucer. The knob is then vigourously manually spun, causing the token to be propelled off the saucer and against the inner surface of the casing cover where it remains by centrifugal force until the casing cover begins to spin more slowly. The token then falls by gravity through the opening of casing cover randomly into one of the segments of the stationary base.

BRIEF DESCRIPTION OF THE DRAWINGS

The above will be clearly understood by having referral to the perferred embodiment of the invention, illustrated by way of the accompanying drawings, in which.

Like numerals indicate like elements throughout the drawings.

DETAILED DESCRIPTION OF THE PREFERRED EMBODIMENT

Figure 1:
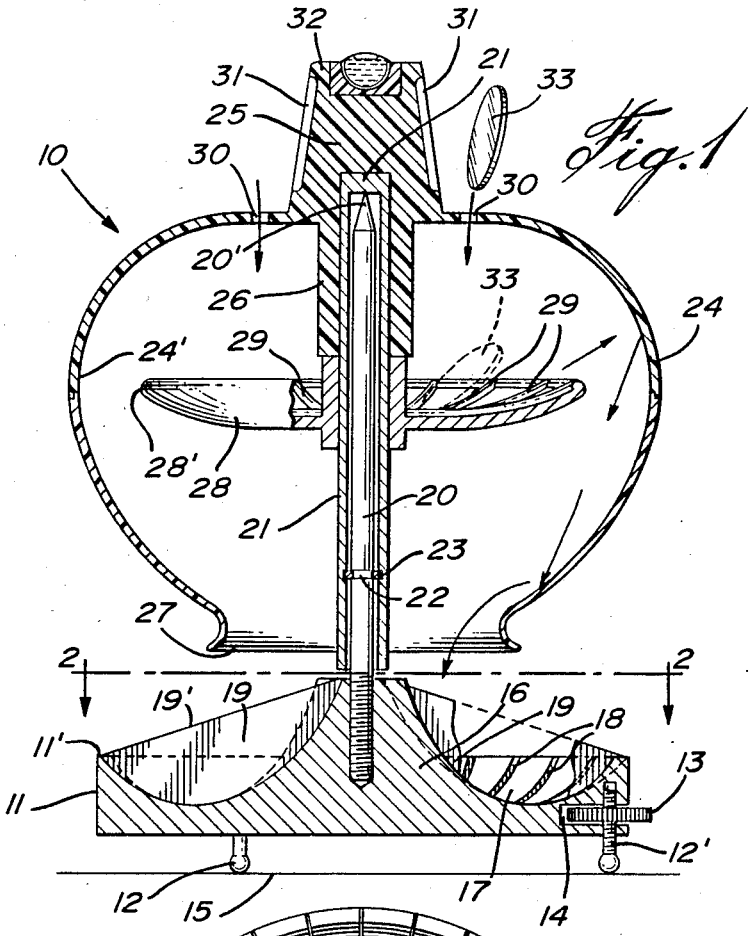
FIG. 1 is a vertically cross-sectioned view of the invention, showing the saucer disk in partial section and a token in perspective.
Figure 2:
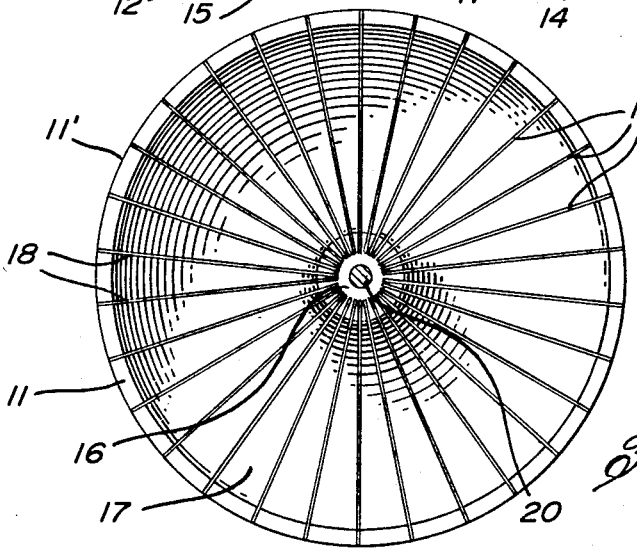
FIG. 2 is a top plan view of the base as seen along lines 2—2 of FIG. 1.

The whirligig, designated at 10, includes a circular stationary base 11 having three ground-engaging legs 12, two of which, 12', have levelling means. The levelling means consists of a small horizontal disk 13 disposed in a slot 14 formed in base 11 adjacent the edge thereof. Each leg 12' is externally threaded, which threading is engaged by a complementary threaded hole made in disk 13.

Each disk 13 has a portion outwardly of the edge of base 11, so that it may be manipulated. Legs 12' are each journalled in axially-aligned bores made above and below slots 14. Thus, rotating a disk 13 in one direction will raise each leg 12' and rotating disk 13 in the other direction will lower leg 12' relative to a surface 15, as is known.

Base 11 has a raised central hub 16 and a concave annular trough 17 extending therearound. This trough 17 is formed with a plurality of straight radial grooves 18 extending from the circumferential edge 11' of the base to hub 16. Preferably, grooves 18 are spaced every twelve degrees, forming thirty grooves in all.

Each groove 18 is adapted to receive an upright partition member 19, each of which has a straight inclined top edge 19' and a lower edge corresponding to the curvature of grooves 18 and trough 17.

An upright vertical spindle 20 is fixedly secured, as by screwing, in hub 16, thereby enabling spindle 20 to be removed for dismantling. Spindle 20 has a pointed upper tip 20'.

The mounting means referred to above consists of an elongated sheeve 21 which is closed at its upper end. The upper end rests on the pointed tip 20', as shown. In order to prevent wobble of spindle 20 in sleeve 21, both the latter are grooved at 22 in their lower end portions to receive a snap clip member 23, which has been previously inserted into the inner groove of sleeve 21.

Sleeve 21 has mounted on it an apple-shaped casing cover 24, made of plastic, which may be transparent. Cover 24 has an uppermost knob 25 integrally formed therewith and a downwardly-projecting cylindrical portion 26. Sleeve 21 is fixedly secured in both portion 26 and the lower part of knob 25.

Cover 24 has a lower opening 27 directly overlying base 11 and is of a smaller diameter than the latter.

Also fixedly mounted on sleeve 21 is a saucer disk 28, of a diameter less than the the diameter of middle area 24' of cover 24. Saucer 28 is only slightly concave, having an upwardly-inclined periphery 28'. Saucer 28 is also preferably provided with a plurality of radial ribs 29.

The upper surface of casing 24 adjacent knob 25 has at least one slit 30, preferably two such slits.

Knob 25 is preferably formed with a gripping means consisting of a plurality of spaced indentations 31. The top of knob 25 is further provided with a spirit bubble level 32 encased therein.

To play with the invention, the players first ensure that the base 11 is accurately horizontal by setting legs 12' with spirit level 32. Partitions 19 are inserted in grooves 18, the number of partitions used depending on the number of players and the size of the segments desired. Then tokens or metal coins 33 are dropped through slots 30, so that they fall onto saucer 28 and cover 24 is given whirling impetus by spinning knob 25. Propelled by ribs 29 each token 33 will be flung by centrifugal force against the inner surface of cover 24 where they remain until the cover slows sufficiently to allow the tokens to fall by gravity into one of the segments in base 11 formed by partitions 19. It will be readily appreciated that such movement of each token 33 is purely random: there is an equal chance that a token will end up in one particular segment.

The winner of a game is the player who has the most tokens in his/her segment at the end, and the loser is the player who has the fewest tokens.

The game is preferably optimally played by two to six players.

What I claim is:

1. A game of chance for use with tokens and comprising a stationary base; leveling means to put the base in accurately horizontal position on a supporting surface; said base having a central hub and a trough surrounding the hub, spaced outwardly from the latter; at least two upright partitions disposed in said trough and defining at least two trough segments; a vertically-projecting spindle secured to said hub; a casing cover having a lowermost opening of a diameter less than the dimensions of said base; mounting means to rotatably mount said casing cover on the spindle; said casing cover being formed with an uppermost upwardly-projecting knob; a saucer disk secured to said mounting means at the general middle area of the casing and being of a lesser diameter than the inner horizontal diameter of the middle area; at least one slit formed in the top portion of said casing cover, whereby dropping a token through said slit onto said saucer disk and subsequently rotating said casing cover, causes the token to fly against the casing cover inside the latter by centrifugal force until a gradual slowdown in rotation of said casing cover allows the token to fall by gravity randomly into one of the segments.

2. A game of chance as defined in claim 1, wherein said base is circular; and said trough is annular and concave.

3. A game of chance as defined in claim 2, wherein said base is supported on three equi-spaced legs; two of said legs being adjustable and provided with said leveling means; the latter consisting of a small horizontal disk disposed in a slot formed therefor in said base; each said leg provided with said disk being externally threaded and passing through a complementary threaded hole made in said disk; both of the adjustable legs being journalled in bores made in said base above and below said slots and adjacent the associated edge of said base.

4. A game of chance as defined in claim 3, wherein a level-indicating means is provided at the top of said knob, consisting of a spirit bubble level.

5. A game of chance as defined in claim 2, wherein said trough is formed with a plurality of radial grooves; each said partition fitting removably into one of said grooves; said partitions having a straight upper edge and a lower edge corresponding to the curvature of said trough.

6. A game of chance as defined in claim 1, wherein said mounting means consists of an elongated sleeve closed at its upper end; the upper tip of said spindle being pointed and supporting said upper end; said spindle and said sleeve being grooved at their lower portions; a snap clip engaging said grooves; said casing cover having a cylindrical portion depending from said knob; said sleeve being fixedly secured in said cylindrical portion; said saucer disk being fixedly secured to said sleeve.

7. A game of chance as defined in claim 6, wherein said saucer disk is slightly concave, having a raised periphery and a plurality of radial ribs.

8. A game of chance as defined in claim 1, wherein said knob is formed with a gripping means.

9. A game of chance as defined in claim 8, wherein said gripping means consists of a plurality of vertically-oriented indentations.

* * * * *